US012292235B2

(12) United States Patent
Haik-Beraud et al.

(10) Patent No.: US 12,292,235 B2
(45) Date of Patent: May 6, 2025

(54) METHOD FOR LIQUEFYING NATURAL GAS WITH IMPROVED EXCHANGER CONFIGURATION

(71) Applicant: L'Air Liquide, Société Anonyme pour l'Etude et l'Exploitation des Procédés Georges Claude, Paris (FR)

(72) Inventors: Natacha Haik-Beraud, Champigny-sur-Marne (FR); Jean-Marc Peyron, Creteil (FR); Sophie Lazzarini, Saint Mande (FR); Thomas Morel, Champs-sur-Marne (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 530 days.

(21) Appl. No.: 17/632,169

(22) PCT Filed: Jul. 20, 2020

(86) PCT No.: PCT/FR2020/051308
§ 371 (c)(1),
(2) Date: Feb. 1, 2022

(87) PCT Pub. No.: WO2021/032916
PCT Pub. Date: Feb. 25, 2021

(65) Prior Publication Data

US 2022/0282912 A1 Sep. 8, 2022

(30) Foreign Application Priority Data

Aug. 1, 2019 (FR) ..... 1908808

(51) Int. Cl.
*F25J 1/00* (2006.01)
*F25J 1/02* (2006.01)

(52) U.S. Cl.
CPC ..... *F25J 1/0022* (2013.01); *F25J 1/0262* (2013.01)

(58) Field of Classification Search
CPC ..... F25J 1/0022; F25J 1/0262; F25J 1/0055; F25J 1/0272; F25J 1/0202; F28D 9/0093; F28D 9/0068; F28F 3/02
See application file for complete search history.

(56) References Cited

U.S. PATENT DOCUMENTS 3,992,168 A 11/1976 Toyama et al.
4,181,174 A 1/1980 Grenier
(Continued)

FOREIGN PATENT DOCUMENTS

EP 1 088 578 4/2001
EP 3 015 807 5/2016
(Continued)

OTHER PUBLICATIONS

Fischer, B., A new process to reduce LNG cost, ICHE Spring Meeting, Natural Gas Utilization Conference, X, US, Mar. 10, 2002, 191-202.
(Continued)

*Primary Examiner* — Frantz F Jules
*Assistant Examiner* — Webeshet Mengesha
(74) *Attorney, Agent, or Firm* — Elwood L. Haynes

(57) ABSTRACT

A method for liquefying a hydrocarbon stream using at least one heat exchanger of the plate and fin type having at least one first part and one second part, the first and second parts being physically separate and each comprising at least one stack of a plurality of plates that are parallel to one another and to a longitudinal direction that is substantially vertical, the plates of the first part and the plates of the second part being stacked in a stacking direction that is orthogonal to the plates, the plates being stacked with spacing so as to define
(Continued)

between them a plurality of first passages for the flow of at least part of a second two-phase cooling stream in the first part and a plurality of second passages for the flow of at least part of a first two-phase cooling stream in the second part.

14 Claims, 8 Drawing Sheets

(56) References Cited

U.S. PATENT DOCUMENTS

| | | | | |
|---|---|---|---|---|
| 4,330,308 | A | 5/1982 | Grenier et al. | |
| 4,646,822 | A | 3/1987 | Voggenreiter et al. | |
| 5,199,266 | A | 4/1993 | Johansen | |
| 5,644,931 | A * | 7/1997 | Ueno | F25J 5/002 62/623 |
| 7,134,296 | B2 * | 11/2006 | Howard | F25J 1/0045 62/611 |
| 2007/0227185 | A1 | 10/2007 | Stone et al. | |
| 2010/0126215 | A1 * | 5/2010 | Court | F25J 1/0247 62/619 |
| 2012/0067079 | A1 | 3/2012 | Sethna et al. | |
| 2015/0260451 | A1 | 9/2015 | Haberberge et al. | |
| 2018/0299210 | A1 | 10/2018 | Ronacher | |
| 2018/0356150 | A1 | 12/2018 | Chambron | |
| 2021/0164734 | A1 | 6/2021 | Haik-Beraud et al. | |

FOREIGN PATENT DOCUMENTS

| | | |
|---|---|---|
| FR | 2 563 620 | 10/1985 |
| FR | 1 857 133 | 2/2020 |
| WO | WO 2014 087225 | 6/2014 |
| WO | WO 2017 081374 | 5/2017 |
| WO | WO 2017 134353 | 8/2017 |
| WO | WO 2018 172644 | 9/2018 |

OTHER PUBLICATIONS

Onaka, M. et al., Use of plate fin heat exchangers for main cryogenic exchanger units, LNG Journal, Nelton Publications, Gravesend, GB, Jan. 1, 1997, 17-19.

Paradowski, H. et al., Experimental study of plate heat exchangers condensing and vaporizing liquefied hydrocarbon gases, GPA Technical Meeting, Feb. 1, 2001, 1-14.

Stone, J. B. et al., LNG process selection considerations for future developments, International Conference and Exhibition of Liquefied Natural Gas (LNG), Apr. 18, 2010, Oran, Algeria, vol. 16, Poster PO1-13, 1-9.

International Search Report for corresponding PCT/FR2020/051308, Oct. 16, 2020.

* cited by examiner

METHOD FOR LIQUEFYING NATURAL GAS WITH IMPROVED EXCHANGER CONFIGURATION

CROSS REFERENCE TO RELATED APPLICATIONS

This application is a 371 of International Application Na PCT/FR2020/051308, filed Jul. 20, 2020, which claims priority to French Patent Application No. 1908808, filed Aug. 1, 2019, the entire contents of which are incorporated herein by reference.

BACKGROUND

The present invention relates to a method for liquefying a hydrocarbon stream, such as natural gas, said method using a two-phase cooling stream that vaporizes against the hydrocarbon stream to be liquefied in a heat exchanger of the plate and fin type.

It is desirable for natural gas to be liquefied for a number of reasons. By way of an example, natural gas can be stored and transported over long distances more easily in the liquid state than in the gaseous state, since it occupies a smaller volume for a given mass and does not need to be stored at high pressure.

Several methods exist for liquefying a natural gas stream in order to obtain liquefied natural gas (LNG). Typically, a cooling stream, generally a mixture containing hydrocarbons, is compressed by a compressor, then introduced into an exchanger, where it is completely liquefied and subcooled to the coldest temperature of the method, typically that of the liquefied natural gas stream. At the coldest outlet of the exchanger, the cooling stream is expanded, forming a liquid phase and a gaseous phase. These two phases are remixed and reintroduced into the exchanger. The cooling stream introduced into the exchanger in the two-phase state is vaporized therein against the hydrocarbon stream that liquefies. Document WO-A-2017081374 describes one of these known methods.

The use of aluminum brazed plate and fin heat exchangers allows highly compact devices to be obtained that provide a large exchange surface area, which improves the energy performance capabilities of the liquefaction method described above.

These exchangers comprise at least one stack of plates that extend in two dimensions, lengthwise and widthwise, thus forming at least one stack of several series of passages, with some being intended for circulating a heat-transfer fluid, in this case the hydrocarbon stream to be liquefied, and others being intended for circulating a refrigerant, in this case the two-phase cooling stream to be vaporized.

Heat exchange structures, such as heat exchange waves, are generally disposed in the passages of the exchanger. These structures comprise fins that extend between the plates of the exchanger and allow the heat exchange surface area of the exchanger to be increased. Conventionally, these heat exchange structures have uniform properties and structures along the passages of the exchanger.

However, certain problems continue to arise with the known liquefaction methods, in particular due to the two-phase composition of the cooling stream reintroduced into the exchanger, and in particular when its vaporization occurs in an upward vertical flow.

Indeed, the two-phase cooling stream is introduced at the cold end of the exchanger, i.e. the end with the lowest temperature of the temperatures of the exchanger, located at the lower end of the exchanger. The partial vaporization rate (or "flash") is very low. As the cooling stream flows through the passages of the exchanger toward the upper end, called hot end, the rate of partial vaporization, and therefore the amount of gas contained in the cooling stream, increases.

However, gas needs to be present in order to entrain the liquid phase of the cooling stream in order to compensate for the effect of gravity. As the amount of gas is lower at the cold end of the exchanger, entraining the liquid with the gas is more difficult. Therefore, the flow rate of the cooling stream is lower at the cold end and then increases toward the upper end of the exchanger, as the cooling stream is vaporized. This results in an inhomogeneous distribution of the cooling stream along the length of the exchanger.

In order to overcome the shortage of gas at the cold end, a known solution involves reducing the cross-section of the exchanger. The cross-section available for circulating the cooling stream is reduced, which allows the volume flow and the flow rate of the cooling stream to be increased at the cold end.

However, this solution results in a major disadvantage. Indeed, the cross-section of the exchanger is designed by considering the cold end, where the flow rate of the cooling stream is the lowest. However, this speed continues to increase along the flow path of the cooling stream, as the amount of gas increases, which leads to an excessively high level of pressure drops at the hot end, due to the reduced cross-section of the exchanger. This results in a degradation of the energy performance capabilities of the method.

SUMMARY

The aim of the present invention is to overcome all or some of the aforementioned problems, in particular by proposing a method for liquefying a hydrocarbon stream against a two-phase cooling stream using a heat exchanger ensuring more homogeneous distribution of said cooling stream in the length of the exchanger.

The solution according to the invention then involves a method for liquefying a hydrocarbon stream, such as natural gas, using at least one heat exchanger of the plate and fin type comprising at least one first part and one second part, said first and second parts being physically separate and each comprising at least one stack of a plurality of plates that are parallel to one another and to a longitudinal direction that is substantially vertical, the plates of the first part and the plates of the second part being stacked in a stacking direction that is orthogonal to the plates, said plates being stacked with spacing so as to define between them a plurality of first passages for the flow of at least part of a second two-phase cooling stream and a plurality of second passages for the flow of at least part of a first two-phase cooling stream in the second part, said method comprising the following steps:

a) passing a hydrocarbon stream through the first part and the second part;

b) introducing at least one cooling stream into the first part via at least one first inlet up to a first outlet, said first inlets and outlets being arranged so that the cooling stream flows through the first part in a downward direction opposite to the longitudinal direction;

c) discharging the cooling stream introduced in step b) via the first outlet of the first part;

d) introducing the cooling stream originating from step c) into the second part via a second inlet up to a second outlet of the second part;

e) expanding the cooling stream originating from step d) so as to produce a first two-phase cooling stream;

f) introducing at least part of the first two-phase cooling stream into the second passages of the second part via at least one third inlet up to a third outlet;

g) discharging the first two-phase cooling stream via the third outlet so as to obtain a second two-phase cooling stream;

h) introducing at least part of the second two-phase cooling stream into the first part via at least a fourth inlet of the first part up to a fourth outlet so that said second two-phase cooling stream flows in an upward direction following the longitudinal direction in the first passages;

i) at least partially vaporizing said at least part of the first two-phase cooling stream in the second passages and said at least part of the second two-phase cooling stream in the first passages by exchanging heat with at least the hydrocarbon stream so as to produce an at least partially liquefied hydrocarbon stream at the outlet of the second part, characterized in that:

the first part has a first fluid passage cross-section defined as the product between the height and the width of a first passage, multiplied by the number of first passages of the first part; and the second part has a second fluid passage cross-section defined as the product between the height and the width of a second passage, multiplied by the number of second passages of the second part, the heights of each of the passages being measured in the stacking direction and the widths of each of the passages being measured in a lateral direction that is orthogonal to the longitudinal direction and parallel to the plates, the second fluid passage cross-section of the second part being smaller than the first fluid passage cross-section of the first part.

As applicable, the invention can comprise one or more of the following features:

the second fluid passage cross-section of the second part is smaller than the first fluid passage cross-section of the first part by a dividing factor that is at least equal to 1.3, preferably less than or equal to 5, more preferably ranging between 1, 5 and 3;

the height of the second passages of the second part is less than the height of the first passages;

the number of second passages is less than the number of first passages;

the plates of the first part and the plates of the second part form one or more stacks that respectively define one or more sub-sets of first passages each forming a first exchange module and one or more sub-sets of second passages each forming a second exchange module, said first exchange modules each having at least one fourth inlet, said fourth inlets of each first module being fluidly connected to a common pipe for supplying a second two-phase cooling stream, and said second exchange modules each having at least one third inlet, said third inlets of each second exchange module being fluidly connected to a common pipe supplying the first two-phase cooling stream;

the first part comprises a number of first exchange modules greater than the number of second exchange modules of the second part;

in step f), the third inlet and the third outlet are arranged so that the first two-phase cooling stream flows in the upward direction in the second passages;

in step f), the third inlet and the third outlet are arranged so that the first two-phase cooling stream flows in the downward direction in the second passages;

in step a), the hydrocarbon stream flows in the downward direction;

the heat exchanger comprises at least one phase separator device suitable for separating a two-phase cooling stream into a gaseous phase and a liquid phase, the first part comprising a phase separator device arranged between the third outlet of the second part and the second inlet of the first part, the second part being devoid of any phase separator device between the second outlet and the third inlet of the second part;

the first and second passages of the first part and of the second part have lengths measured in the longitudinal direction, said lengths being less than 8 m, preferably less than 5 m;

in step a), the hydrocarbon stream successively circulates in the first part and in the second part, with the hydrocarbon stream being introduced into the second part in the completely liquefied state;

at least one from among: the cooling stream, the hydrocarbon stream, the two-phase cooling stream has a difference between its temperature when introduced into the second part and its temperature when discharged from said second part ranging between 10 and 40° C., preferably between 10 and 30° C.;

prior to step a), at least one additional refrigeration cycle is implemented comprising the following steps:

i) introducing a supply stream comprising a mixture of hydrocarbons, such as natural gas, into an additional heat exchanger;

ii) introducing the cooling stream into the additional heat exchanger;

iii) introducing an additional cooling stream into the additional heat exchanger;

iv) extracting, from the heat exchanger, at least two partial cooling streams originating from the additional cooling stream and expanding said partial cooling streams to different pressure levels in order to produce at least two two-phase refrigerants;

v) reintroducing at least part of said refrigerants into the additional heat exchanger;

vi) cooling the supply stream and the cooling stream by exchanging heat with at least said two-phase refrigerants, so as to obtain a pre-cooled hydrocarbon stream at the outlet of the additional heat exchanger;

vii) introducing the hydrocarbon stream and the cooling stream originating from the additional heat exchanger into the heat exchanger.

The expression "natural gas" relates to any composition containing hydrocarbons, at least including methane. This comprises a "crude" composition (prior to any treatment or scrubbing) and also any composition that has been partially, substantially or completely treated for the reduction and/or removal of one or more compounds, including, but without being limited thereto, sulfur, carbon dioxide, water, mercury and certain heavy and aromatic hydrocarbons.

BRIEF DESCRIPTION OF THE DRAWINGS

The present invention will now be better understood by virtue of the following description, which is provided solely by way of a non-limiting example and with reference to the accompanying figures, in which.

DETAILED DESCRIPTION OF PREFERRED EMBODIMENTS

Figure 1:
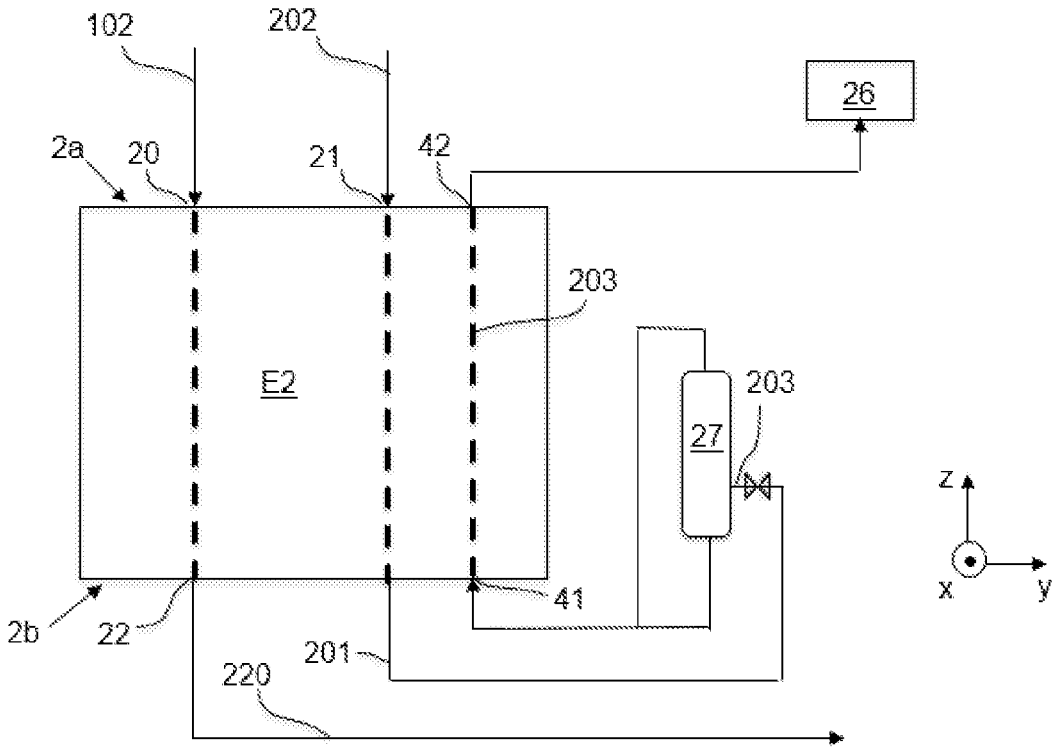
FIG. 1 schematically shows a method for liquefying a hydrocarbon stream according to the prior art.

FIG. 1 schematically shows a method for liquefying a hydrocarbon stream 102 according to the prior art. The hydrocarbon stream is preferably natural gas, optionally pre-treated, for example, having undergone the separation of at least one of the following constituents: water, carbon dioxide, sulfur compounds, methanol, before being introduced into the heat exchanger E2.

Preferably, the natural gas stream comprises, as a mole fraction, at least 60% methane, preferably at least 80%.

The natural gas 102 can be fractionated, i.e. part of the C2+ hydrocarbons containing at least two carbon atoms is separated from the natural gas using a device that is known to a person skilled in the art. The collected C2+ hydrocarbons are sent into fractionating columns comprising a de-ethanizer. The light fraction collected at the top of the de-ethanizer can be mixed with natural gas 102. The liquid fraction collected at the bottom of the de-ethanizer is sent to a de-propanizer.

The hydrocarbon stream 102 and a cooling stream 202 enter a heat exchanger E2, respectively through a fifth inlet 20 and a first inlet 21, in order to circulate therein in dedicated passages of the exchanger in directions parallel to the longitudinal direction z, which is substantially vertical during operation.

The first inlet 21 for the cooling stream 202 and the fifth inlet 20 for the hydrocarbon stream are located at a first end of the exchanger 2*a*, so that the hydrocarbon stream 102 and the cooling stream 202 flow co-currently in the downward direction, toward a second end 2*b* of the exchanger E2, which is located, in the longitudinal direction z, at a level below the level of the first end 2*a*.

The first end corresponds to the hot end of the exchanger, i.e, the end with the highest temperature of the exchanger E2, with this highest temperature preferably being the temperature for introducing the hydrocarbon stream (into 20). By contrast, the cold end of an exchanger, also called "cold tip", is the end with the lowest temperature of the exchanger, i.e. the end where a fluid is introduced at the highest temperature of all the exchanger temperatures.

Upon exiting the exchanger E2, the cooling stream 201 is expanded by an expansion component, such as a turbine, a valve or a combination of a turbine and a valve, so as to form a liquid phase and a gaseous phase. These two phases can be separated beforehand in a separator 27 before being recombined and reintroduced into the exchanger E2 in the liquid-gas mixture state, i.e. two-phase.

At least part of the two-phase cooling stream 203 is reintroduced into the exchanger E2 via a second inlet 41 located at the second end 2*b* and supplying a plurality of passages 10 of the exchanger. The two-phase cooling stream 203 flows through passages 10 in an upward direction and is vaporized by counter-currently refrigerating the natural gas 102 and the cooling stream 202.

The vaporized cooling stream exits the exchanger E2 via a second outlet 42 in order to be compressed by a compressor and then cooled in the indirect heat exchanger by exchanging heat with an external cooling fluid, for example, water or air (in 26 in FIG. 1). The pressure of the cooling stream at the outlet of the compressor can range between 2 MPa and 8 MPa. The temperature of the cooling stream at the outlet of the indirect heat exchanger can range between 10° C. and 45° C.

However, as explained above, the inventors of the present invention have demonstrated that with a conventional exchanger configuration, disparities in pressure drops and flow rates appear as the two-phase cooling stream flowed along the passages 10, in particular due to the progressive vaporization of said cooling stream along the length of the exchanger.

In order to overcome these problems, the invention proposes separating the heat exchanger E2 into at least two separate parts: a first part E2 and a second part E2.

Preferably, the first part has a higher temperature level than that of the second part. These at least first and second parts each form a separate exchanger, preferably they are of the brazed plate and fin type.

Figure 2:
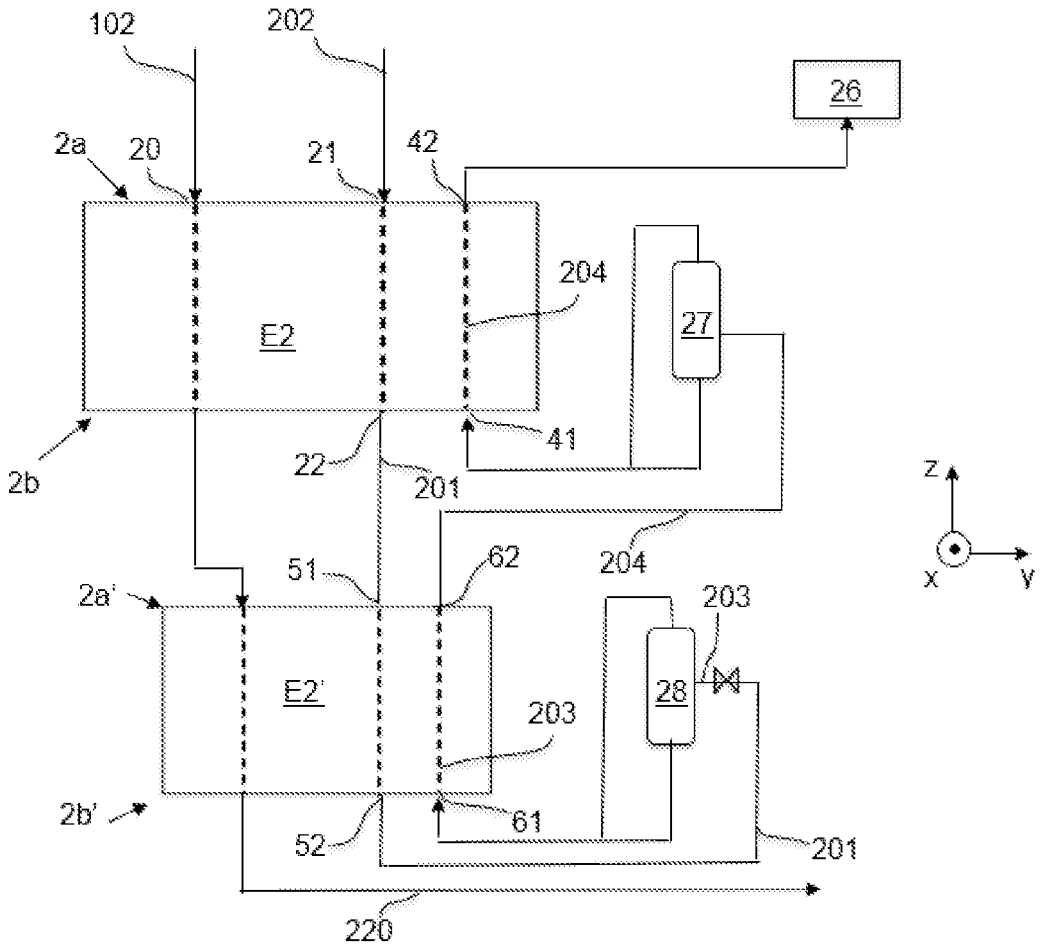
FIG. 2 schematically shows a method for liquefying a hydrocarbon stream according to one embodiment of the invention.

FIG. 2 schematically shows the circulation of the fluids of the method in a two-part exchanger according to one embodiment of the invention. It is understood that all or some of the features of the prior art that would not contradict the invention can be applied to the method according to the invention.

The hydrocarbon stream 102 circulates in at least one first part E2 and one second part E2' disposed in series.

Preferably, the hydrocarbon stream 102 is first introduced via a fifth inlet 20 of the first part E2 at a first temperature T1. An at least partially liquefied hydrocarbon stream 101 is obtained at the outlet of the first part E2 at a second temperature T2 lower than the first temperature T1.

Preferably, the hydrocarbon stream 102 is introduced into the first part E2 in the completely gaseous or partially liquefied state at a temperature ranging between −80 and −35° C.

According to another possibility, the hydrocarbon stream 102 is introduced into the first part E2 in the completely liquefied state at a temperature ranging between −130 and −100° C.

The stream 101 is then introduced into the second part E2' and a stream of completely liquefied and sub-cooled hydrocarbons 220 is obtained at the outlet of the second part E2', at a third temperature T3 below the second temperature T2. Preferably, the hydrocarbon stream 102 flows in the downward direction. Preferably, the third temperature T3 ranges between −105 and −145° C.

Advantageously, the hydrocarbon stream 102 is introduced into the heat exchanger E2' in the at least partially or even completely liquefied state.

The cooling stream 202 circulates in the first part E2 from at least one first inlet 21 located at a first end 2*a* of the first part E2 toward a first outlet 22 located at a second end 2*b* of the first part E. The first end 2*b* is positioned at a lower level relative to the first end, so that the cooling stream 202 flows parallel to the longitudinal direction z, but in a downward direction that is opposite to the direction z.

The cooling stream 202 is formed, for example, by a mixture of hydrocarbons and nitrogen, such as a mixture of methane, ethane and nitrogen, but can also contain propane and/or butane. Preferably, said hydrocarbons contain at most three carbon atoms, preferably at most two carbon atoms. The mole fraction proportions (%) of the components of the cooling stream can be:

Nitrogen: 0% to 10%;

Methane: 30% to 70%;

Ethane: 30% to 70%;

Propane: 0% to 10%.

Advantageously, the hydrocarbon stream 102 flows co-currently with the cooling stream 202.

The cooling stream exits 201 from the first part E2 in order to enter the second part E2' via at least one second inlet 51 of the second part E2' located at a third end 2*a*' of the second part E2'.

The cooling stream 201 originating from the second part E2' is expanded, preferably by at least one turbine, a valve, or a combination of the two, so as to produce a first two-phase cooling stream 203 that is reintroduced into the second part E2' by at least one third inlet 61 located at a fourth end 2*b*'. The first two-phase cooling stream 203 flows through second passages 10' of the second part E2'.

The first two-phase cooling stream 203 exits via a third outlet 62 of the second part E2' and results in a second two-phase cooling stream 204 that is introduced into the first part E2 via at least one fourth inlet 41 located at the second end 2*b*, so that said second two-phase cooling stream 204 flows through the first passages 10 of the first part E2 in an upward direction oriented in the longitudinal direction z.

It should be noted that reintroducing said at least part of the first two-phase cooling stream 203 and/or said at least part of the second two-phase cooling stream can be carried out in several ways.

The two phases of these two-phase streams 203 and/or 204 can be separated beforehand in a separator component 27 and/or 28 before being recombined outside the exchanger and reintroduced into the exchanger E2 in the liquid-gas mixture state via the same inlet 61 and/or 41, as shown in FIG. 2. The separator component can be any device suitable for separating a two-phase fluid into a gas stream, on the one hand, and a liquid stream, on the other hand. In this case, the two-phase stream is entirely or almost entirely reintroduced.

According to an alternative embodiment (not shown), the liquid and gaseous phases of the streams can be separately introduced into the exchanger via separate inlets, then mixed together within the exchanger, by means of a mixing device, as described in FR-A-2563620 or WO-A-2018172644, for example. These devices are typically machined parts comprising a particular arrangement of separate channels for a liquid phase and a gaseous phase and of orifices placing these passages in fluid communication in order to dispense a liquid-gas mixture. The two-phase stream 203 is thus entirely or almost entirely reintroduced.

According to another alternative embodiment (not shown), only the liquid phases separated from the two-phase streams 203, 204 are reintroduced via the inlets 61, 41. This liquid phase forms said part of the two-phase cooling stream 203. The gaseous phase is preferably diverted from the exchanger E2, i.e. it is not introduced therein.

It should be noted that the two-phase fluids optionally can be directly reintroduced in the liquid-gas mixture state.

Preferably, said at least part of the first two-phase cooling stream 203 is reintroduced into the second part E2' at a temperature ranging between −120 and −160° C.

Preferably, said at least part of the second two-phase cooling stream 204 exits the first part E2 at a temperature above the temperature for reintroducing the first two-phase stream into the second part E2', preferably ranging between −35 and −130° C.

The liquefaction of the hydrocarbon stream 101, 102 occurs by exchanging heat with at least the first two-phase cooling stream 203 in the second part E2' and the second two-phase cooling stream 204 in the first part E2.

The natural gas exits the exchanger E2' in the liquefied state 220 at a temperature that preferably is at least 10° C. higher than the bubble point of the liquefied natural gas produced at atmospheric pressure (the bubble point refers to the temperature at which the first vapor bubbles form in a liquid natural gas at a given pressure) and at a pressure identical to the natural gas inlet pressure, to the nearest pressure drops. For example, the natural gas exits the exchanger E2' at a temperature ranging between −105° C. and −145° C. and at a pressure ranging between 4 MPa and 7 MPa. Under these temperature and pressure conditions, the natural gas does not remain entirely liquid after expansion to atmospheric pressure.

The first and second exchanger parts E2, E2' are plate and fin type exchangers each comprising a plurality of plates 221, 222, . . . that are parallel to one another and to the longitudinal direction z, which is substantially vertical.

Figure 3:
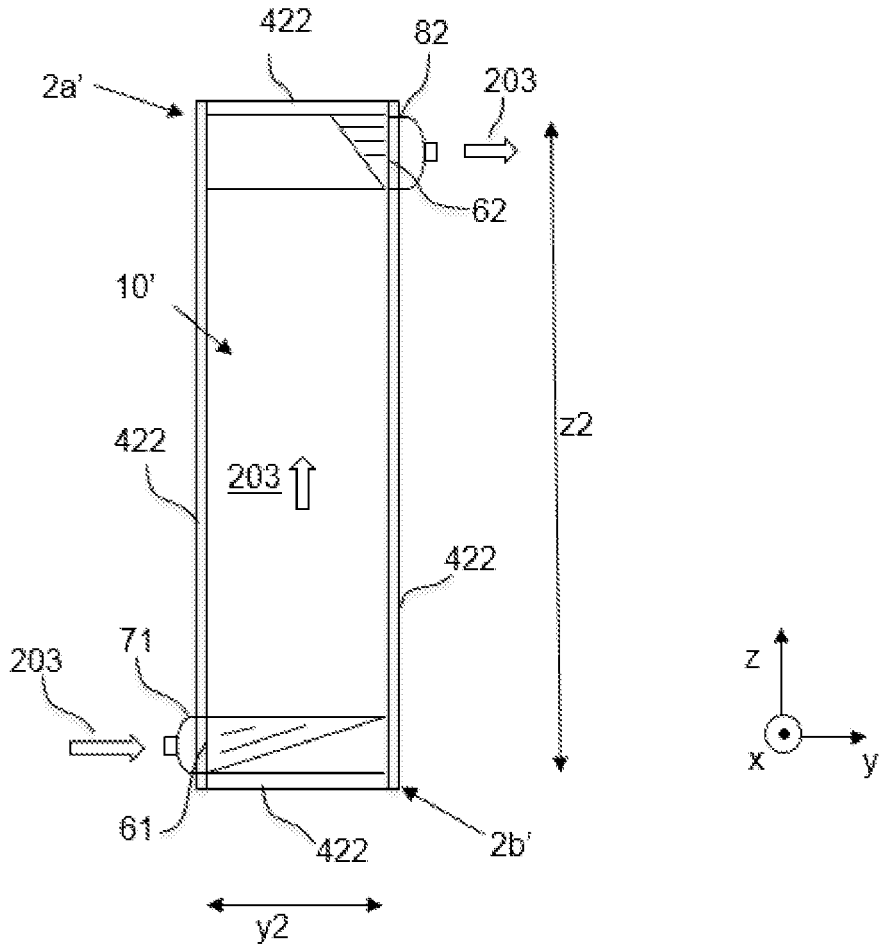
FIG. 3 is a schematic section view, in a plane parallel to the plates of the exchanger, of a passage configured for the flow of a two-phase cooling stream according to one embodiment of the invention.
Figure 4:
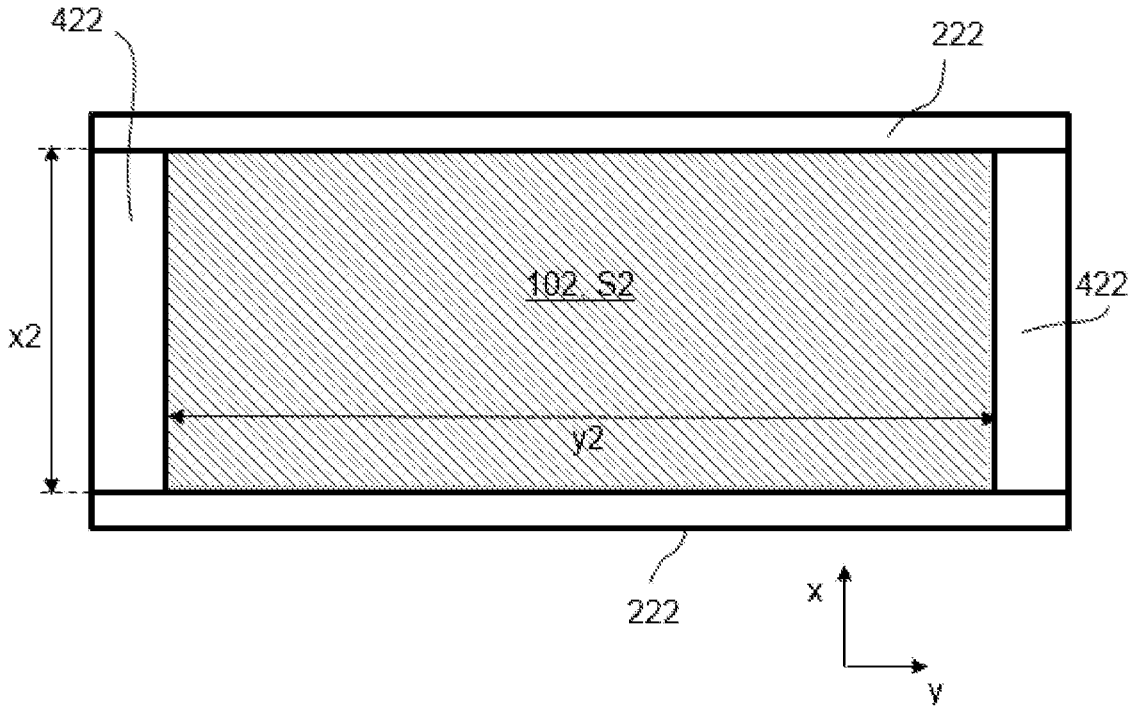
FIG. 4 is a schematic section view of passages for the flow of two-phase cooling streams according to one embodiment of the invention, in a plane orthogonal to the plates of the exchanger and orthogonal to the longitudinal direction.

FIG. 3 and FIG. 4 schematically show the second passages of the second part E2' along two orthogonal cutting planes. This description is applicable to the first passages 10, which have a similar structure.

FIG. 3 shows a second passage 10' configured to vaporize the first two-phase cooling stream 203. The second part E2' comprises a plurality of plates 202 (not shown) that are disposed parallel to one another with spacing in a stacking direction x that is orthogonal to the plates 222 and to the longitudinal direction z.

Preferably, separating sheets 422 are interposed between the plates 222, so as to define a plurality of second passages 10' with said plates 222. A second passage 10' is formed between two adjacent plates 202. The second passages are not necessarily adjacent. Preferably, each passage of the first part E2' has a parallelepiped and flat shape and the plates 202 of the first part E2' have substantially the same dimensions in the z and y directions, so that a stack of plates and passages has an overall parallelepiped shape.

The separating sheets 422 do not completely block the passages 10', but leave inlet 61 and outlet 62 openings. The inlets and outlets 61, 62 of each of the second passages 10' are joined by manifolds 71, 82 used for introducing and discharging the two-phase cooling stream 203.

In the second part E2', the hydrocarbon stream 101 circulates in another series of calorigenic passages (not shown) that are fully or partly arranged alternating and/or adjacent to all or part of the second passages 10'. The flow of fluids in the passages generally occurs parallel to the longitudinal direction z. In FIG. 3, the first two-phase stream 203 circulates in an upward direction.

As can be seen in FIG. 4, a second passage 10' has a height x2 that is measured in the stacking direction x and a width y2 that is measured in a lateral direction y, which is orthogonal to the longitudinal direction z and parallel to the plates 222. The length z2 of a second passage 10', measured in the longitudinal direction z, is shown in FIG. 3. The first passages 10' have substantially the same dimensions.

Similarly, a first passage 10 (not shown) has a height x1 measured in the stacking direction x and a width y1 measured in the lateral direction y.

The fluid passage cross-section of a passage of the first or the second part is defined as the surface area of the transverse cross-section of said passage, measured in a plane orthogonal to the longitudinal direction z. This surface area corresponds to the product between the width and the height of a passage.

Each exchanger part therefore has a total fluid passage cross-section corresponding to the sum of the transverse cross-sections of each passage forming said part.

It is understood that for each part E2, E2', the passages 10, 10' can belong to one or more stacks of plates forming one or more modules, called "cores". In a known manner, these modules are supplied at the same time by the fluids of the method.

For each part, when it is formed by a plurality of stacks or modules, the total number of passages that they include therefore will be considered in order to define the total fluid passage cross-section, whether or not these passages form part of the same exchanger module.

According to the invention, the first part E2 has a first fluid passage cross-section S1, defined as the product between the height x1 and the width y1 of a first passage 10, multiplied by the number N1 of first passages 10 of the first part E2, and the second part E2' has a second fluid passage cross-section S2, defined as the product between the height x2 and the width y2 of a second passage 10', multiplied by the number N2 of second passages 10' of the second part E2', with S2 being less than S1. N1 and N2 are whole numbers greater than 1.

Thus, by separating the exchanger E2 into at least two separate parts, several stages are separated where the successive vaporization of the two-phase stream occurs. This allows the fluid passage cross-sections of each part to be sized appropriately. In this case, the cross-section of the second part E2' is reduced, where the first two-phase cooling stream 203 is first introduced and where the vaporization begins, since it is the coldest part of the exchanger in which the first two-phase cooling stream contains relatively little gas. Reducing the fluid passage cross-section allows the pressure drops and the flow rate to be increased, promoting the ascent of the first two-phase stream 203 in the second part E2'.

As the two-phase cooling stream flows and exchanges heat with the hydrocarbon stream, the rate of partial vaporization, and therefore the amount of gas, increases. The first part is therefore designed with a larger passage cross-section than that of the second part, which reduces the pressure drops for the second two-phase stream 204 flowing in the first part E2.

The exchanger according to the invention allows the pressure drops to be balanced along the length of the first and second passages and allows a reasonable level of pressure drops to be maintained at the hot end. The energy performance capabilities of the industrial installation integrating the exchanger according to the invention are improved.

This also allows high enough fluid flow rates to be provided over the entire length of the passage, in particular at the cold end where entraining the liquid phase is critical. This results in a more uniform distribution of the two-phase cooling stream and an improvement in the performance capabilities of the exchanger. The exchanger thus can be designed with reduced safety margins compared to the margins that should be provided in the absence of structures according to the invention.

In addition, the exchanger can operate in steps called reduced steps, i.e. a lower flow rate, whether in a transient operating mode or in a steady state mode.

The passages 10, 10' of the first part E2 and the second part E2' can have respective lengths z1, z2 measured in the longitudinal direction z, with said lengths z1, z2 being less than 8 m, preferably less than 5 m. The lengths of the first and second passages can be designed so as to preserve the same total exchange length as with a conventional exchanger. Thus, a conventional exchanger E2 according to the prior art has a length of passages for the two-phase cooling stream of at least 6 m, preferably ranging between 6 and 10 m.

FIG. 2 shows an exchanger divided into two separate parts E2 and E2', with it being understood that the exchanger can be divided into a larger number of parts, which allows even finer balancing. Said parts will have fluid passage cross-sections that increase in the longitudinal direction z.

For example, the exchanger E2 can comprise at least one intermediate part E2" arranged between the first part E2 and the second part E2', and comprising intermediate passages, in which an intermediate two-phase cooling stream flows that originates from the first two-phase stream 203. Said at least one intermediate part will have an intermediate fluid passage cross-section S3 as defined above, with S3 being larger than S2 and smaller than S1.

Preferably, the second fluid passage cross-section S2 is smaller than the first fluid passage cross-section S1 by a dividing factor that is at least equal to 1.3, preferably less than or equal to 5, more preferably ranging between 1.5 and 3.

Such a dividing factor allows effective balancing of the pressure losses experienced by the first and second two-phase cooling streams 203 and 204 at the second and first parts, respectively, in particular when the first stream 203 flows through the second part E2' with a liquid/gas volume ratio that is preferably greater than 2 to 20% relative to the liquid/gas volume ratio of the second stream 204 flowing through the first part E2.

It should be noted that, preferably, the first two-phase cooling stream 203 introduced into the second part E2' has a liquid/gas volume ratio ranging between 10 and 100%, preferably between 10 and 60%, with said ratio of a two-phase stream being defined as the ratio between the volume flow rate of the liquid phase and the volume flow rate of the gaseous phase of said stream.

According to one embodiment, the reduction of the second cross-section S2 relative to the first cross-section S1 is achieved by reducing the dimensions, namely the width and/or the height, of the second passages 10' of the second part E2' relative to the dimensions of the first passages 10.

In particular, the reduction of the second section S2 relative to the first section S1 can be achieved by reducing the height of the second passages 10' of the second part E2' relative to the height of the first passages 10. The width of the passages 10, 10' and/or the number of passages 10, 10' optionally can be identical.

It is also possible to arrange a number N2 of second passages 10' that is less than the number N1 of first passages 10. The first and second passages 10, 10' optionally can have substantially identical heights and/or widths. Therefore, the stacking height of the passages is reduced.

According to a particular embodiment, the first part E2 comprises a plurality of sub-sets of first passages 10 each forming a first exchange module 21A, 21B, . . . , and the second part E2' comprises a plurality of sub-sets of second passages 10' each forming a second exchange module 22*a*, 22*b*, . . . . The parts E2, E2' then each form a set of a plurality of modules, called "cores", disposed in parallel.

Figure 5:
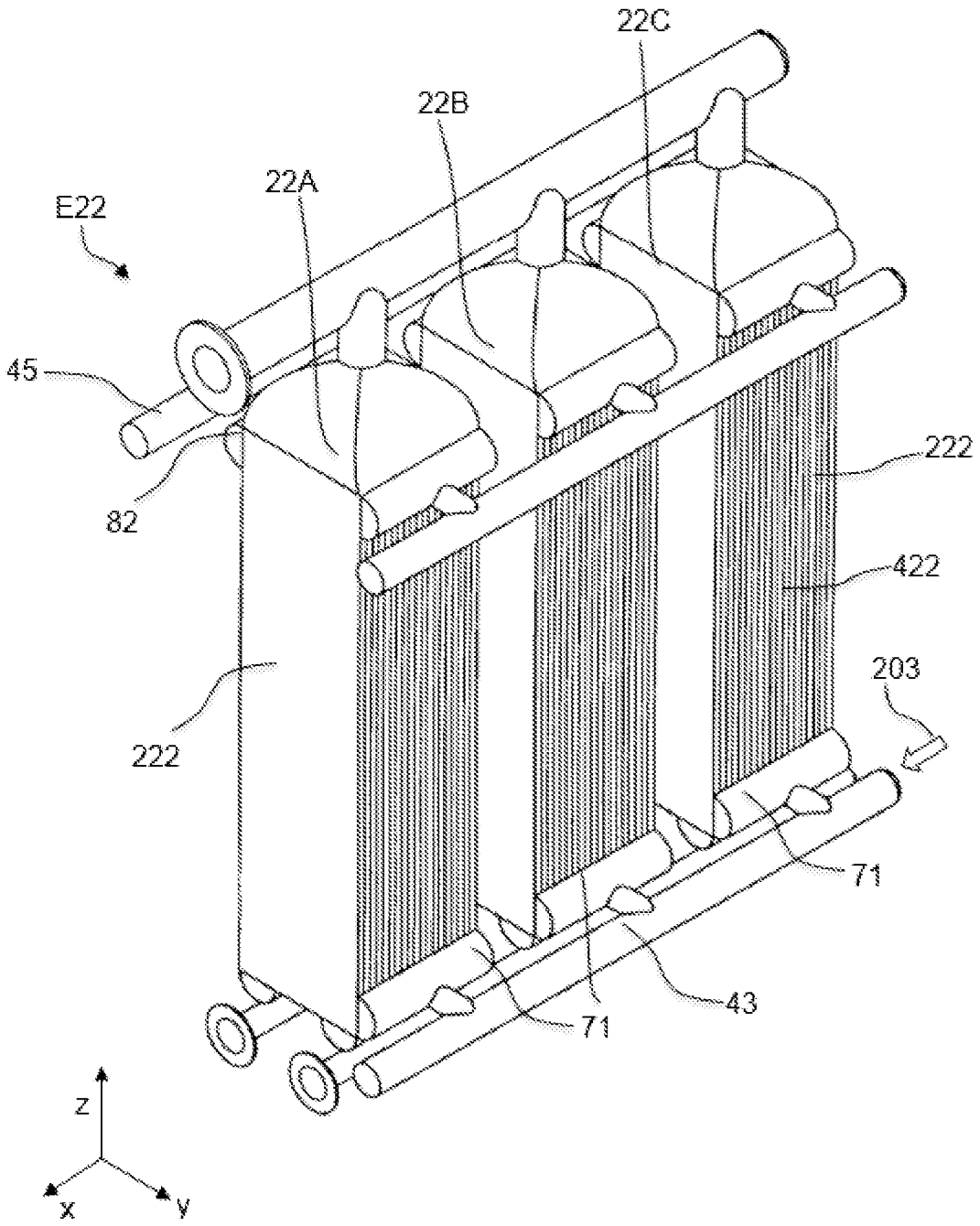
FIG. 5 shows part of an exchanger according to one embodiment of the invention.

FIG. 5 shows an example of such an arrangement for the first part E2'. The second exchange modules 22*a*, 22*b*, . . . each comprise at least one third inlet 61A, 61B, . . . . Said third inlets of each second exchange module are fluidly connected, preferably via inlet manifolds 71 arranged on each module, to a common supply pipe 43, which supplies the second passages 10' of each module 22*a*, 22*b* with the first two-phase cooling stream 203. The first two-phase stream 203 is discharged from each module 22*a*, 22*b* via third outlets 62*a*, 62*b*, . . . joined by outlet manifolds 82, which are connected to a common discharge pipe 45.

These features set forth for the second part E2' can be applied to the first part E2 and are not described for the sake of brevity.

Advantageously, the second part E2' comprises a number of second exchange modules 22*a*, 22*b*, . . . that is less than the number of first exchange modules 21A, 21B, . . . of the first part. Thus, exchange modules can be used in the exchanger E2, the passage dimensions of which exchange modules and the number of passages are substantially equal, which rationalizes the costs and simplifies the manufacture of the unit. The fluid passage cross-section is reduced by reducing the number of modules, thereby reducing the total number of passages of the second part.

In the embodiment shown in FIG. 2, the fourth end 2*b*' and the at least one third inlet 61 for the first two-phase cooling stream 203 is located, following the longitudinal direction z, at a level below that of the third end 2*a*'. The first two-phase cooling stream 203 therefore flows in an upward direction in the second passages 10', just like the second two-phase cooling stream 204.

According to an alternative embodiment, the fourth end 2*b*' with the at least one third inlet 61 is located, in the longitudinal direction z, at a level above the level of the third end 2*a*', so that the first two-phase cooling stream 203 flows downward in the second passages 10'. In the second reversed part E2', the liquid phase of the first two-phase stream 203 descends under the effect of gravity. Therefore, having a relatively high liquid/gas volume ratio at the fourth end 2*b*' is less critical for the progression of the two-phase stream in the exchanger. Thus, additional degrees of freedom are available in terms of the design of the heat exchanger, since a minimum flow rate no longer needs to be provided to maintain good initial distribution of the first two-phase stream.

Figure 7:
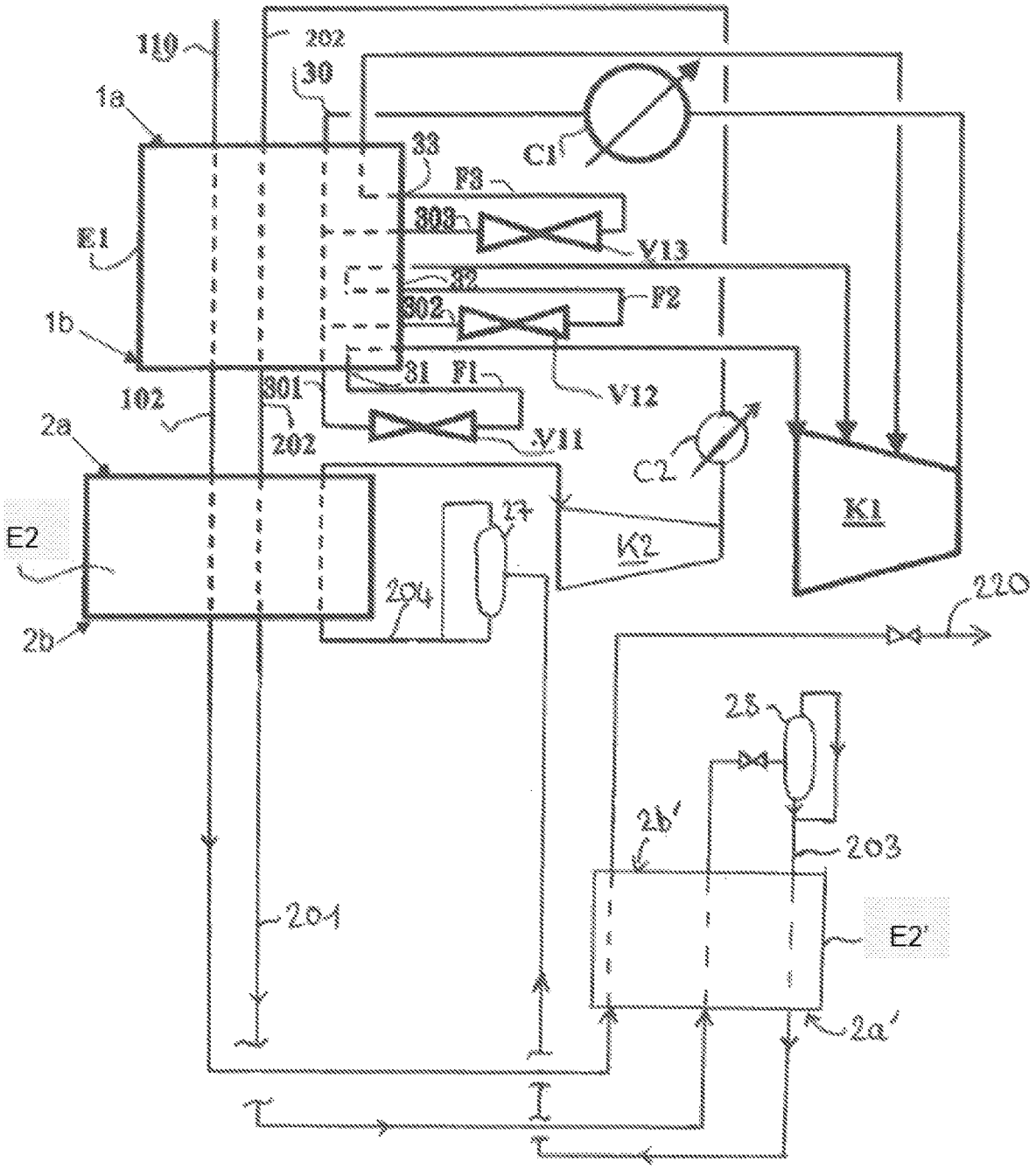
FIG. 7 schematically shows a method for liquefying a hydrocarbon stream according to another embodiment of the invention.

This alternative embodiment is shown in FIG. 7, which illustrates a method for liquefying a hydrocarbon stream with at least one additional refrigeration cycle, noting that the second part E2' can be reversed outside this context, in particular in a method with a refrigeration cycle as shown in FIG. 2.

Preferably, the two-phase streams 204, 203 exiting each part E2, E2' are separated into a liquid phase and a gaseous phase in phase separator devices 27, 28. Any known device can be used, such as a separator pot using a step of compressing and cooling the two-phase stream. The two phases of each two-phase stream are then recombined according to the various possibilities previously described.

Optionally, the method according to the invention does not comprise any separator device 28 associated with introducing the first two-phase stream 203 into the second part E2'. Indeed, the temperature gradient in this second part is relatively low. A "temperature gradient" is understood to mean the difference between the temperature at which a fluid is introduced into and is discharged from the second part, i.e. the temperature difference over which the fluids circulating in the second part are heated or cooled, as applicable. This difference is substantially the same for all fluids. Typically, for each fluid, the difference between its inlet temperature and its outlet temperature from the second part E2' ranges between 10 and 40° C., preferably between 10 and 30° C. This is particularly the case for a second part E2' with a length for the passages that is less than or equal to 5 m. It should be noted that normally the temperature gradients are more of the order of 80 to 110° C. for a conventional exchanger.

Due to its reduced passage cross-section, the second part E2' is less sensitive to maldistribution than a conventional single-part exchanger E2, i.e. an exchanger according to the prior art in which the fluid passage cross-section for the two-phase stream is constant over the length of the exchanger. Therefore, a separator device optionally can be dispensed with.

Figure 8:
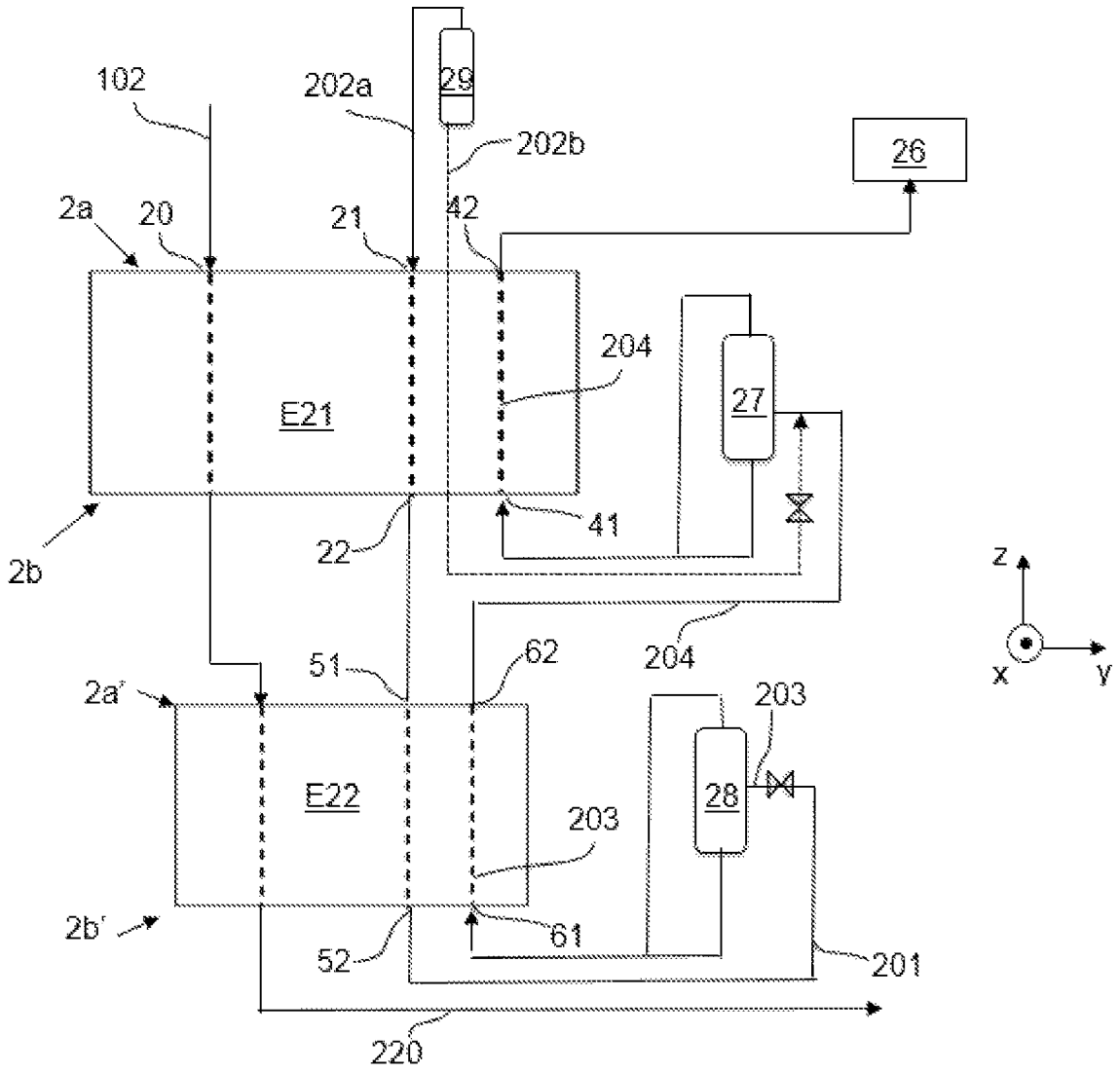
FIG. 8 schematically shows a method for liquefying a hydrocarbon stream according to another embodiment of the invention.

It should be noted that it is possible to contemplate introducing a plurality of cooling streams 202*a*, 202*b* into the first part E2, as shown in FIG. 8. These streams are gaseous and liquid phases originating from a separator 29 supplied with a stream 202 expanded to a given level. Upon exiting the first part, the liquid phase is expanded and then recombined with the stream 204 before the separator 27. The gaseous phase 202*a* circulates in the first and the second part E2, E2'. Several expansion levels can be implemented, resulting in several cooling streams 202*a*, 202*b*, 202*c*, . . . .

Advantageously, the method for liquefying a hydrocarbon stream according to the invention can implement one or more additional refrigeration cycles carried out upstream of the main refrigeration cycle described above, so as to pre-cool the hydrocarbon stream.

Figure 6:
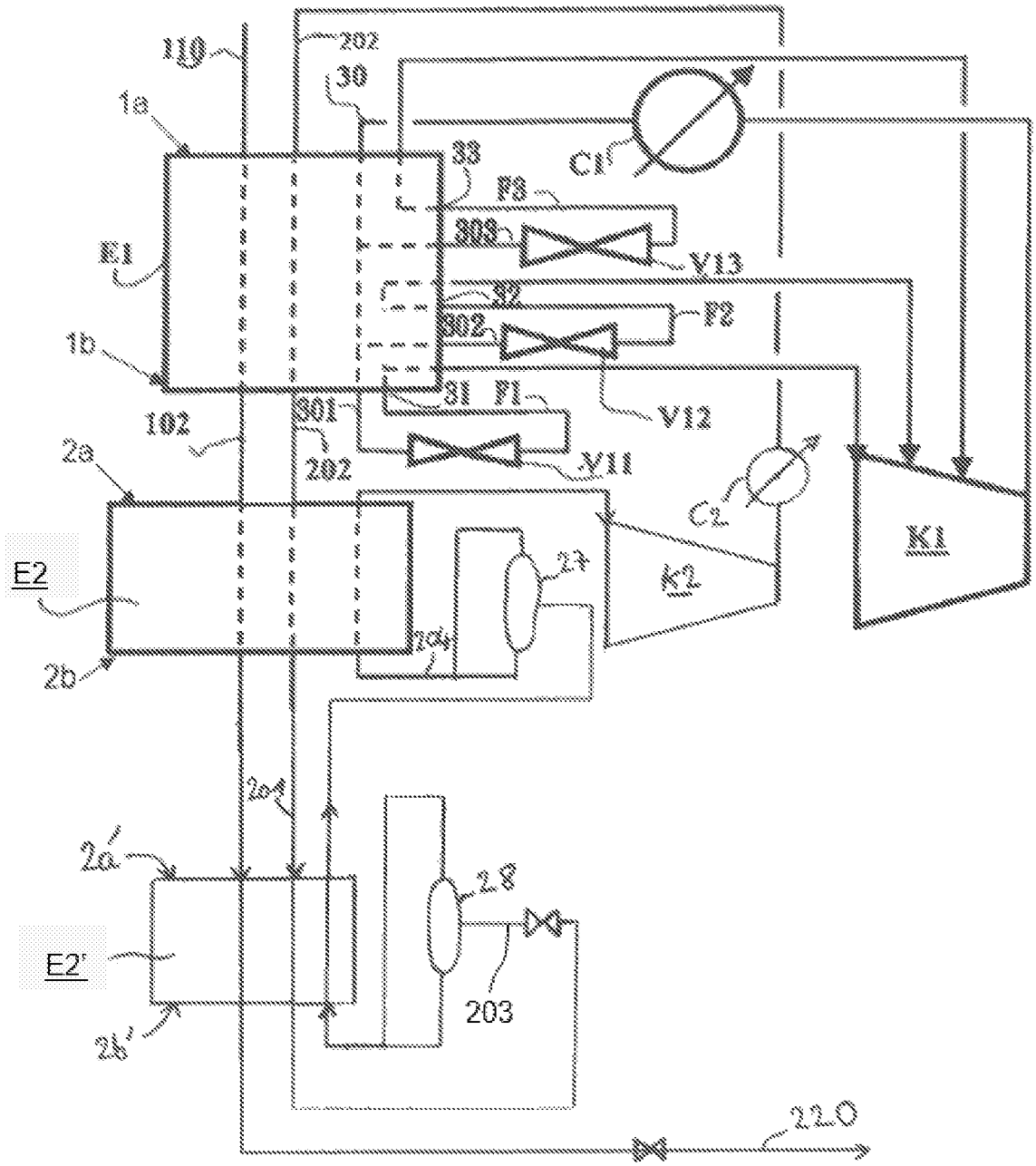
FIG. 6 schematically shows a method for liquefying a hydrocarbon stream according to another embodiment of the invention.

FIG. 6 and FIG. 7 schematically show a method for liquefying a hydrocarbon stream, such as natural gas, comprising an additional refrigeration cycle, in which the natural gas is cooled to its dew point using at least two different expansion levels in order to increase the efficiency of the cycle. This additional refrigeration cycle is implemented by means of an additional cooling stream in an additional heat exchanger E1, called pre-cooling exchanger, arranged upstream of the heat exchanger E2, which then forms the liquefaction exchanger.

In this embodiment, a supply stream 110 arrives, for example, at a pressure ranging between 4 MPa and 7 MPa and at a temperature ranging between 30° C. and 60° C. With the supply stream 110 comprising a mixture of hydrocarbons, such as natural gas, the cooling stream 202 and the additional cooling stream 30 enter the exchanger E1 in order to circulate therein in parallel directions and co-currently in the downward direction.

A cooled hydrocarbon stream 102 exits the pre-cooling exchanger E1, for example, at a temperature ranging between −35° C. and −70° C. The cooling stream 202 exits the exchanger E1 completely condensed, for example, at a temperature ranging between −35° C. and −70° C. The stream 102 is then introduced into the first part E2.

The vaporized cooling stream exits the second part E2' in order to be compressed by the compressor K2 and then cooled in the indirect heat exchanger C2 by exchanging heat with an external cooling fluid, for example, water or air. The second cooling stream originating from the exchanger C2 is sent into the exchanger E1 via the pipe 20.

The additional cooling stream 30 can be formed by a mixture of hydrocarbons, such as a mixture of ethane and propane, but also can contain methane, butane and/or pentane. The mole fraction proportions (%) of the components of the first cooling mixture can be:

Ethane: 30% to 70%;

Propane: 30% to 70%;

Butane: 0% to 20%.

In the method described in FIG. 6 and FIG. 7, the cooling stream 202 is not split into separate fractions, but, in order to optimize the approach in the exchanger E2, the cooling stream also can be separated into two or three fractions, with each fraction being expanded to a different pressure level and then sent to different stages of the compressor K2.

In the exchanger E1, which is also of the plate and fin type, at least two partial streams originating from the additional cooling stream are withdrawn from the exchanger at two separate outlet points and then expanded to different pressure levels, thus forming the at least one first and one second separate refrigerant fluid F1 and F2 reintroduced into the exchangers via separate inlets 31, 32 selectively supplying additional refrigerant passages in order to be vaporized therein with the supply stream, the cooling stream and part of the additional cooling stream.

In the embodiment according to FIG. 8, three fractions, also called partial flows or streams, 301, 302, 303 of the additional cooling stream 30 in the liquid phase are successively withdrawn. The fractions are expanded through the expansion valves V11, V12 and V13 to three different pressure levels, forming a refrigerant F1, a second refrigerant F2 and a third refrigerant F3. These three refrigerants F1, F2, F3 are reintroduced into the exchanger E1 and then vaporized.

The three vaporized refrigerants F1, F2, F3 are sent to different stages of the compressor K1, compressed and then condensed in the condenser C1 by exchanging heat with an external cooling fluid, for example, water or air. The first cooling stream originating from the condenser C1 is sent into the exchanger E1 via the pipe 30. The pressure of the first cooling stream at the outlet of the compressor K1 can range between 2 MPa and 6 MPa. The temperature of the additional cooling stream at the outlet of the condenser C1 can range between 10° C. and 45° C. The refrigerants F1, F2, F3 flow from the cold end 1*b* of the exchanger E1 to its hot end 1*a* in the longitudinal direction z, in the upward direction.

Of course, the invention is not limited to the specific examples described and illustrated in the present application. Other alternative forms or embodiments within the competence of a person skilled in the art may also be contemplated without departing from the scope of the invention. For example, other configurations for injecting and extracting fluids into and from the exchanger, other directions of flow of the fluids, other types of fluids, other types of heat exchange structures, etc. clearly can be contemplated, depending on the constraints stipulated by the method to be implemented.

The invention claimed is:

1. A method for liquefying a hydrocarbon stream using at least one plate and fin heat exchanger comprising at least one first part and one second part, said first and second parts being physically separate and each comprising at least one stack of a plurality of plates that are parallel to one another and to a longitudinal direction that is vertical, the plates of the at least one first part and the plates of the at least one second part being stacked in a stacking direction that is orthogonal to the plates, said plates being stacked with spacing so as to define between them a plurality of first passages for a flow of at least part of a second two-phase cooling stream in the first part and a plurality of second passages for a flow of at least part of a first two-phase cooling stream in the second part, said method comprising:

a) passing a hydrocarbon stream through the first part and the second part;

b) introducing at least one cooling stream into the first part via at least one first inlet up to a first outlet, the at least one first inlet and the first outlet being arranged so that the at least one cooling stream flows through the first part in a downward direction opposite to the longitudinal direction;

c) discharging the cooling stream introduced in step b) via the first outlet of the first part;

d) introducing the cooling stream originating from step c) into the second part via a second inlet up to a second outlet of the second part;

e) expanding the cooling stream originating from step d) so as to produce the first two-phase cooling stream;

f) introducing at least part of the first two-phase cooling stream into the plurality of second passages of the second part via at least one third inlet up to a third outlet;

g) discharging the first two-phase cooling stream via the third outlet so as to obtain the second two-phase cooling stream;

h) introducing at least part of the second two-phase cooling stream into the first part via at least one fourth inlet of the first part up to a fourth outlet so that said second two-phase cooling stream flows in an upward direction following the longitudinal direction in the plurality of first passages;

i) at least partially vaporizing said at least part of the first two-phase cooling stream in the plurality of second passages and said at least part of the second two-phase cooling stream in the plurality of first passages by exchanging heat with at least the hydrocarbon stream so as to produce an at least partially liquefied hydrocarbon stream at an outlet of the second part, wherein:

the first part has a first fluid passage comprising a height and a width, and a cross-section defined as the product of the height and the multiplied by a number of the plurality of first passages of the first part; and the second part has a second fluid passage cross-section defined as the product between the height and the width of a second passage, multiplied by the number of the plurality of second passages of the second part, the heights of each of the passages being measured in the stacking direction and the widths of each of the passages being measured in a lateral direction that is orthogonal to the longitudinal direction and parallel to the plates, the second fluid passage cross-section of the second part being smaller than the first fluid passage cross-section of the first part.

2. The method as claimed in claim 1, wherein the second fluid passage cross-section of the second part is smaller than the first fluid passage cross-section of the first part by a dividing factor that is at least equal to 1.3.

3. The method as claimed in claim 1, wherein the height of the plurality of second passages of the second part is less than the height of the plurality of first passages.

4. The method as claimed in claim 1, wherein the number of the plurality of second passages is less than the number of the plurality of first passages.

5. The method as claimed in claim 1, wherein the plates of the first part and the plates of the second part form one or more stacks that respectively define one or more sub-sets of the plurality of first passages each forming a first exchange module and one or more sub-sets of the plurality of second passages each forming a second exchange module, said first exchange module each having at least one of the at least one fourth inlet, said fourth inlets of the first exchange module and the second exchange module being fluidly connected to a common pipe for supplying a second two-phase cooling stream, and said second exchange module each having at least one third inlet, said at least one third inlets of the second exchange module being fluidly connected to a common pipe for supplying the first two-phase cooling stream.

6. The method as claimed in claim 5, wherein the first part comprises a number of first exchange module greater than the number of second exchange module of the second part.

7. The method as claimed in claim 1, wherein, in step f), the third inlet and the third outlet are arranged so that the first two-phase cooling stream flows in the upward direction in the plurality of second passages.

8. The method as claimed in claim 1, wherein, in step f), the third inlet and the third outlet are arranged so that the first two-phase cooling stream flows in the downward direction in the plurality of second passages.

9. The method as claimed in claim 1, wherein, in step a), the hydrocarbon stream flows in the downward direction.

10. The method as claimed in claim 1, wherein at the least one heat exchanger comprises at least one phase separator device suitable for separating the two-phase cooling stream into a gaseous phase and a liquid phase, the first part comprising a phase separator device arranged between the third outlet of the second part and the second inlet of the first part, the second part being devoid of any phase separator device between the second outlet and the third inlet of the second part.

11. The method as claimed in claim 1, wherein the plurality of first passages and the plurality of second passages of the first part and of the second part have lengths measured in the longitudinal direction, said lengths being less than 8 m.

12. The method as claimed in claim 1, wherein, in step a), the hydrocarbon stream successively circulates in the first part and in the second part, with the hydrocarbon stream being introduced into the second part in a completely liquefied state.

13. The method as claimed in claim 1, wherein at least one from among: the first two-phase cooling stream, the second two-phase cooling stream, the hydrocarbon stream, the two-phase cooling stream has a difference between a temperature when introduced into the second part and a temperature when discharged from said second part ranging between 1° and 40° C.

14. The method as claimed in claim 1, wherein, prior to step a), at least one additional refrigeration cycle is implemented comprising the following steps:

i) introducing a supply stream comprising a mixture of hydrocarbons into an additional heat exchanger;

ii) introducing the cooling stream into the additional heat exchanger;

iii) introducing an additional cooling stream into the additional heat exchanger;

iv) extracting, from the additional heat exchanger, at least two partial cooling streams originating from the additional cooling stream and expanding said said at least two partial cooling streams to different pressure levels in order to produce at least two two-phase refrigerants;

v) reintroducing at least part of said at least two two-phase refrigerants into the additional heat exchanger;

vi) cooling the supply stream and the cooling stream by exchanging heat with the at least at least two two-phase refrigerants, so as to obtain a pre-cooled hydrocarbon stream at the outlet of the additional heat exchanger;

Vii) introducing the hydrocarbon stream and the cooling stream originating from the additional heat exchanger into the heat exchanger.

* * * * *